US009630313B2

(12) United States Patent
Ou

(10) Patent No.: US 9,630,313 B2
(45) Date of Patent: Apr. 25, 2017

(54) DISPLAY BOARD FOR SOCKET

(71) Applicant: Yu-Hua Ou, Taichung (TW)

(72) Inventor: Yu-Hua Ou, Taichung (TW)

( * ) Notice: Subject to any disclaimer, the term of this patent is extended or adjusted under 35 U.S.C. 154(b) by 180 days.

(21) Appl. No.: 14/517,633

(22) Filed: Oct. 17, 2014

(65) Prior Publication Data

US 2016/0107306 A1 Apr. 21, 2016

(51) Int. Cl.
*B25H 3/04* (2006.01)
*B25H 3/00* (2006.01)

(52) U.S. Cl.
CPC ..... *B25H 3/003* (2013.01); *B25H 3/04* (2013.01)

(58) Field of Classification Search
CPC ..... B25H 3/04; A47F 5/0006; A47B 81/00
See application file for complete search history.

(56) References Cited

U.S. PATENT DOCUMENTS 4,688,672 A * 8/1987 Pemberton ..... B25H 3/003 206/378
5,511,673 A * 4/1996 Folk ..... B25H 3/003 206/378
6,044,985 A * 4/2000 Kao ..... B25H 3/003 211/70.6
6,098,799 A * 8/2000 Lee ..... B25H 3/003 206/350
6,644,474 B1 * 11/2003 Lai ..... B25H 3/003 206/372
7,841,480 B2 * 11/2010 Hsieh ..... B25H 3/06 206/378
8,376,153 B1 * 2/2013 Lee ..... B25H 3/003 206/377
9,138,890 B2 * 9/2015 Lee ..... B25H 3/003
2003/0213760 A1 * 11/2003 Lee ..... B25H 3/003 211/70.6
2005/0221664 A1 * 10/2005 Winnard ..... B25H 3/003 439/510
2011/0089126 A1 * 4/2011 Hsieh ..... B25H 3/003 211/70.6
2013/0126449 A1 * 5/2013 Sh ..... B25H 3/04 211/4

* cited by examiner

*Primary Examiner* — Anthony Stashick
*Assistant Examiner* — James Way
(74) *Attorney, Agent, or Firm* — Muncy, Geissler, Olds & Lowe, P.C.

(57) ABSTRACT

A display board for socket is provided, for assembling of at least one socket thereto. The socket includes a positioning hole including a large-diameter hole and a small-diameter hole. The display board includes a main body. At least one side of the main body is formed with an assembling portion. The assembling portion includes at least one stepped engagement portion protrudedly formed on a surface of the main body. The stepped engagement portion includes a large-diameter engagement portion and a small-diameter portion. The large-diameter engagement portion includes a first lateral surface, and the small-diameter portion includes a second lateral surface. When the stepped engagement portion is inserted in the positioning hole, the first lateral surface corresponds to and is tightly engaged with an inner wall of the large-diameter hole, and the second lateral surface corresponds to and is releasingly assembled within the small-diameter hole.

6 Claims, 3 Drawing Sheets

DISPLAY BOARD FOR SOCKET

BACKGROUND OF THE INVENTION

Field of the Invention

The present invention relates to a display board, and more particularly to a display board for socket.

Description of the Prior Art

A prior art of a display board for a socket to assemble thereto is disclosed in TWI404658. It includes a hanging frame, a back plate and a bottom base. The bottom base has a bottom surface aligning with a bottom edge of the back plate. The bottom base includes an engaging slot and a hanging member. The hanging member is formed via plastic injection molding and formed with a base plate to assemble to the engaging slot. The hanging member is formed with a plurality of fastening members for penetrating through the base plate and fixing the base plate to the bottom base. The top surface of the bottom plate is protrudedly and space-apart formed with a plurality of cylinders which are for the socket to sleeve on.

However, a structure of the display board as described above is for a socket without a stepping inner hole to sleeve thereon. If a socket has the stepping inner hole (such as a socket with a sleeve member assembled in an inner hole), the sleeve member is easily departed from the socket when the socket and the display board are disassembled from each other, because the sleeve member is overly engaged with the display board. And it causes a function of the socket to fail. And if the sleeve member and the display board are releasingly assembled to each other, the socket fails to assemble to the display board steadily and easily falls off from the display board.

The present invention has arisen to mitigate and/or obviate the afore-described disadvantages.

SUMMARY OF THE INVENTION

The primary object of the present invention is to provide a display board. The display board includes a stepped engagement portion which is for a socket to engagedly sleeve thereon. It is convenient for the socket to store and display. A sleeve member assembled in the socket is undeparted from the socket when the socket and the stepped engagement portion are disassembled from each other. It is convenient and safe in using. The sleeve member is further positioned and works with a stable function.

To achieve the above object, a display board in accordance with present invention is for assembling of at least one socket thereto. The socket includes a positioning hole including a large-diameter hole and a small-diameter hole which are continuous. The display board includes a main body. At least one side of the main body is formed with an assembling portion. The assembling portion includes at least one stepped engagement portion protrudedly formed on a surface of the main body. The stepped engagement portion includes a large-diameter engagement portion and a small-diameter portion. The large-diameter engagement portion includes a first lateral surface, and the small-diameter portion includes a second lateral surface. When the stepped engagement portion is inserted in the positioning hole, the first lateral surface corresponds to and is tightly engaged with inner wall of the large-diameter hole, and the second lateral surface corresponds to and is releasingly assembled within the small-diameter hole.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
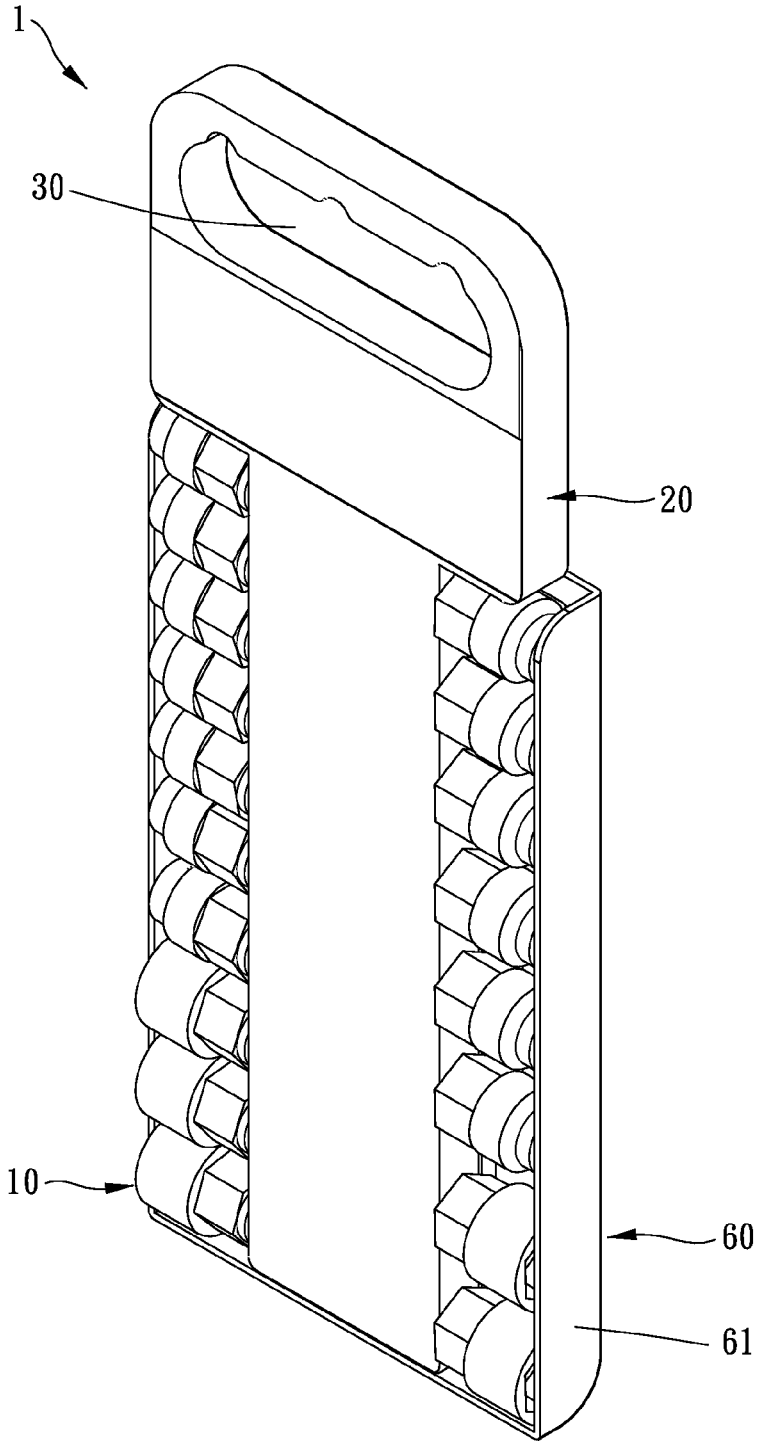
FIG. 1 is a three-dimensional drawing of a preferable embodiment of the present invention.
Figure 2:
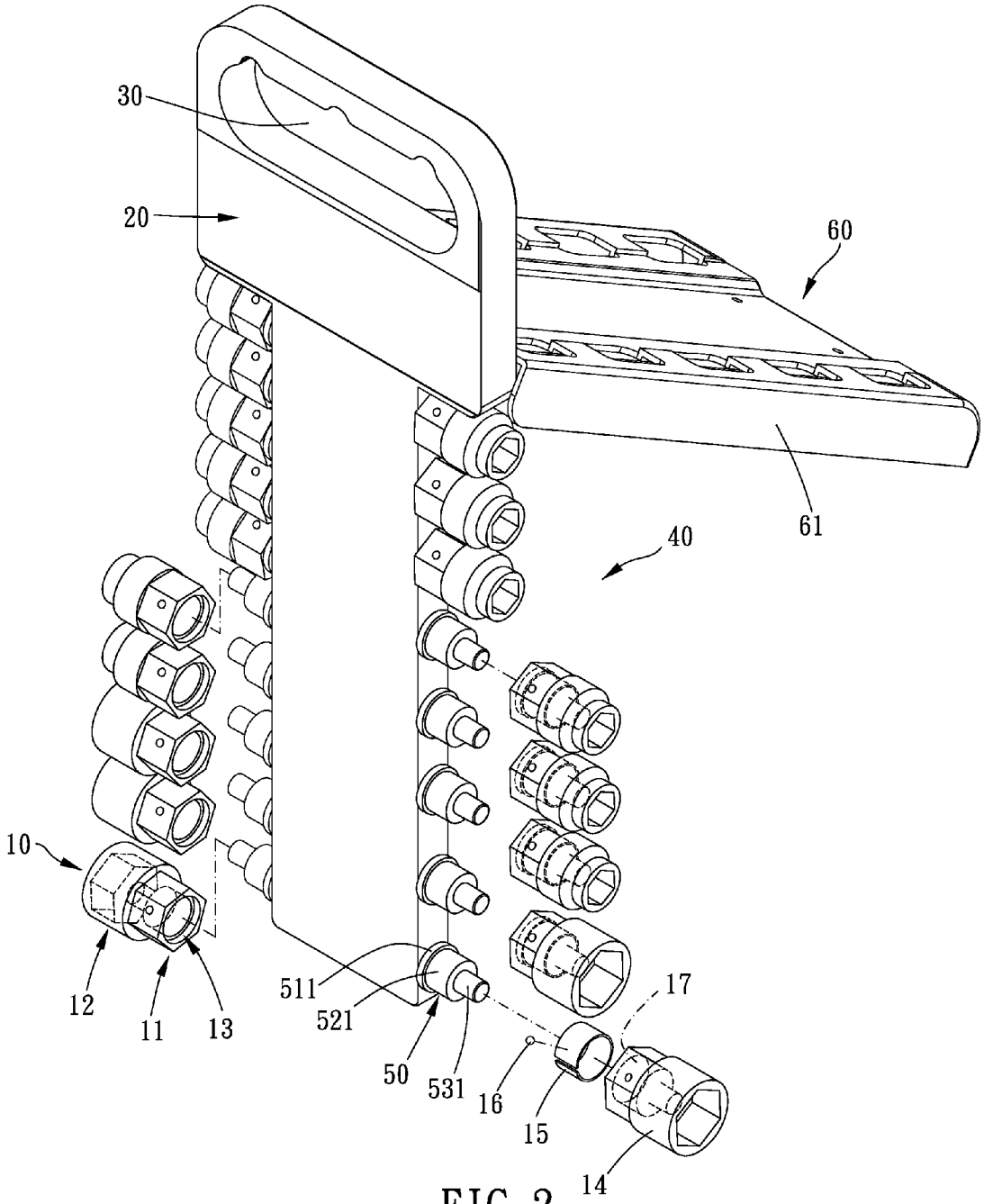
FIG. 2 is a breakdown drawing of the preferable embodiment of the present invention.
Figure 3:
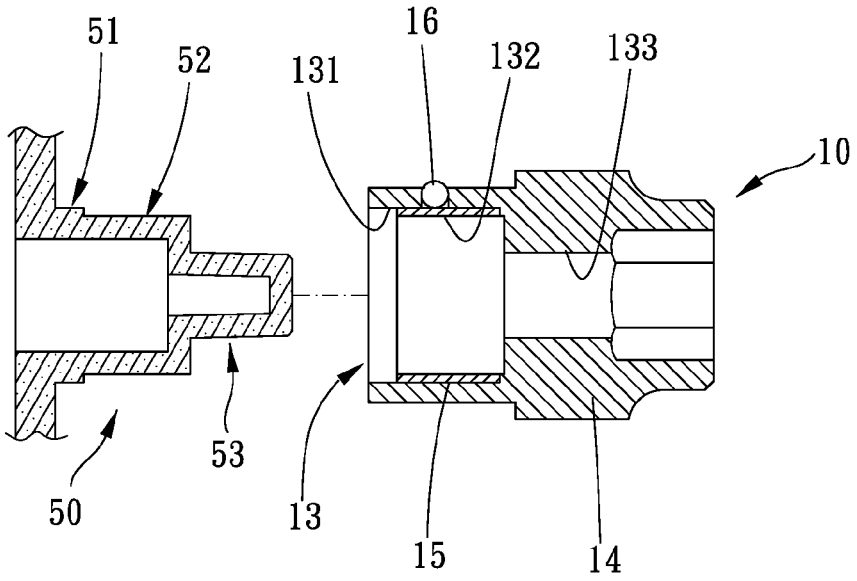
FIG. 3 is a cross-sectional drawing of the preferable embodiment of the present invention in disassembling status.

Please refer to FIGS. 1-3, a display board 1 for socket in accordance with a preferred embodiment of the present invention is for assembling of at least one socket 10 thereto. The display board 1 includes a main body 20.

The socket 10 includes a connecting end 11 and a working end 12. The connecting end 11 is for assembling with a driving tool and includes a positioning hole 13. The driving tool is such as a connecting member of a pneumatic tool or other tools which can connect with the connecting end 11. In the present embodiment, the socket 10 includes a socket body 14, a sleeve member 15 and a ball body 16. The socket body 14 is formed with an opening 17 at the assembling end 11. The ball body 16 is penetratedly disposed at the socket body 14 and protrusive out of a surface of the socket body 14. The sleeve member 15 is radially abutted in the opening 17 and radially outwardly abutted against the ball body 16. The sleeve member 15 is such as a C-shaped ring. The ball body 16 is for engagedly connecting with the driving tool sleeved on the socket 10 so that the driving tool is hard to fall off from the connecting end 11. The positioning hole 13 includes a large-diameter hole 131 and a small-diameter hole 132 which are continuous from outside to inside. Moreover, a portion of the opening 17 between an end of the positioning hole 13 and the sleeve member 15 defines the large-diameter hole 131, and the sleeve member 15 is formed with the small-diameter hole 132.

The main body 20 is formed with a hanging portion 30 at one end. At least one side of the main body 20 is formed with an assembling portion 40. The assembling portion 40 includes at least one stepped engagement portion 50 protrudedly formed on a surface of the main body 20. The stepped engagement portion 50 is for inserting in the positioning hole 13.

For example, the main body 20 is such as plastic. The main body 20 is formed via injection molding directly. Moreover, the stepped engagement portion 50 includes a large-diameter engagement portion 51 protrudedly formed on the surface of the main body 20 and a small-diameter portion 52 coaxially and protrudedly formed on the large-diameter engagement portion 51. Specifically, the large-diameter engagement portion 51 and the small-diameter portion 52 form a stepping shape therebetween. The large-diameter engagement portion 51 includes a first lateral surface 511 on an outer circumferential surface thereof, and the small-diameter portion 52 includes a second lateral surface 521 on an outer circumferential surface thereof. Wherein the first and second lateral surfaces 511, 521 can be respectively a circumferential surface, or the first and second lateral surfaces 511, 521 can be respectively a discontinuous and space-apart surface.

Figure 4:
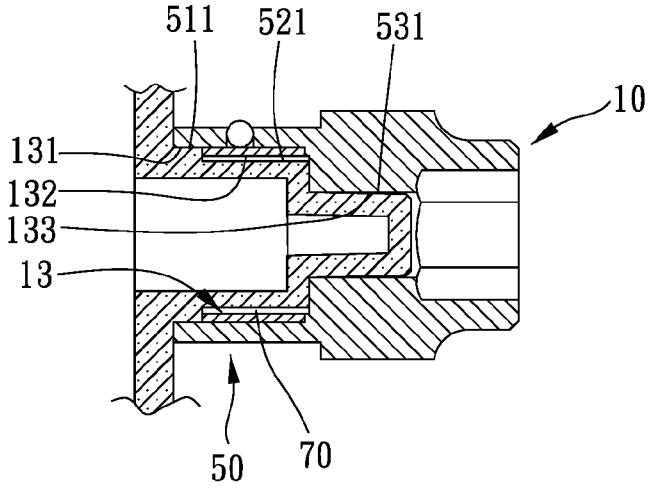
FIG. 4 is a cross-sectional drawing of the preferable embodiment of the present invention in assembling status.

Please refer to FIG. 4, practically, when the stepped engagement portion 50 is inserted in the positioning hole 13, the first lateral surface 511 corresponds to and is tightly engaged with an inner wall of the large-diameter hole 131. The second lateral surface 521 corresponds to and is releasingly assembled within the small-diameter hole 132, and a gap 70 is formed between the second lateral surface 521 and an inner wall of the small-diameter hole 132. Moreover, the first lateral surface 511 and the inner wall of the large-diameter hole 131 are tightly engaged with each other annularly. Nevertheless, the first lateral surface 511 and the inner wall of the large-diameter hole 131 can be tightly engaged with each other partially. The socket 10 is steadily engaged to the display board 1, and it is convenient for the socket 10 to store and display. It is noted that the second lateral surface 521 and the inner wall of the small-diameter hole 132 are formed with a predetermined space therebetween and releasingly assembled with each other so that the sleeve member 15 is undeparted from the socket 10 when the socket 10 and the stepped engagement portion 50 are disassembled from each other. It is convenient and safe in using. Moreover, when the stepped engagement portion 50 is inserted into the positioning hole 13, the large-diameter engagement portion 51 is abutted against the sleeve member 15 so that the sleeve member 15 is positioned in the positioning hole 13 and works with a stable function.

Preferably, the positioning hole 13 further includes an inner hole 133 communicated with the small-diameter hole 132. In the present embodiment, the stepped engagement portion 50 further includes an inner hole engagement portion 53 coaxially and protrudedly formed on the small-diameter portion 52. The inner hole engagement portion 53 includes a third lateral surface 531 on an outer circumferential surface thereof. When the stepped engagement portion 50 is inserted in the positioning hole 13, the third lateral surface 531 corresponds to and is tightly engaged with an inner wall of the inner hole 133. Moreover, the third lateral surface 531 and the inner wall of the inner hole 133 are tightly engaged with each other annularly. Nevertheless, the third lateral surface 531 and the inner wall of the inner hole 133 can be tightly engaged with each other partially. Preferably, the inner hole engagement portion 53 is tapered along an axial direction or the inner hole engagement portion 53 includes a chamfer at an end adjacent to outside. When the socket 10 is sleeved to the stepped engagement portion 50, the socket 10 is conveniently guided. It increases a stability for the socket 10 to engage to the stepped engagement portion 50 because the inner hole engagement portion 53 is engaged with the inner hole 133. Nevertheless, in other embodiments, the stepped engagement portion 50 can exclude the inner hole engagement portion 53. The socket 10 can engagedly disposed on the display board 1 via engaging with the large-diameter engagement portion 51.

In the present embodiment, the display board 1 further includes a shell member 60. The shell member 60 is pivoted to the main body 20 and swingable between a limiting position and an opening position. For example, the shell member 60 is pivoted to the main body 20 via two pivot ears, and the shell member 60 rotates around the main body 20 via two said pivot ears. The shell member 60 includes at least one blocking portion 61. When the shell member 60 is located at the limiting position, the at least one blocking portion 61 corresponds to the at least one stepped engagement portion 50 to limit the at least one socket 10 sleeved on the at least one stepped engagement portion 50 to remain between the at least one blocking portion 61 and the main body 20, and the socket 10 is protected. When the shell member 60 is located at the opening position, the at least one blocking portion 61 is away from the at least one stepped engagement portion 50 to allow the at least one socket 10 sleeved on the at least one stepped engagement portion 50 to disassemble from the at least one stepped engagement portion 50, and the socket 10 is taken out conveniently.

As a conclusion, the display board as described above includes the stepped engagement portion which is for the socket to engagedly sleeve thereon. It is convenient for the socket to store and display. The sleeve member assembled in the socket is undeparted from the socket when the socket and the stepped engagement portion are disassembled from each other. It is convenient and safe in using. The sleeve member is further positioned and works with a stable function.

While we have shown and described various embodiments in accordance with the present invention, it should be clear to those skilled in the art that further embodiments may be made without departing from the scope of the present invention.

What is claimed is:

1. A display board with at least one socket, the at least one socket including a connecting end and a working end, the connecting end for assembling with a driving tool and including a positioning hole, the positioning hole including a large-diameter hole and a small-diameter hole which are continuous from outside to inside, the display board comprising:

a main body, formed with a hanging portion at one end, at least one side of the main body formed with an assembling portion, the assembling portion including at least one stepped engagement portion protrudedly formed on a surface of the main body, the stepped engagement portion being inserted in the positioning hole, the stepped engagement portion including a large-diameter engagement portion protrudedly formed on the surface of the main body and a small-diameter portion coaxially and protrudedly formed on the large-diameter engagement portion, the large-diameter engagement portion including a first lateral surface on an outer circumferential surface thereof, the small-diameter portion including a second lateral surface on an outer circumferential surface thereof;

wherein the large-diameter engagement portion and the small-diameter portion of the stepped engagement portion are inserted in the positioning hole, the first lateral surface corresponds to and is releasably tightly engaged with an inner wall of the large-diameter hole, the second lateral surface corresponds to and is located within the small-diameter hole, and a gap is formed between the second lateral surface and an inner wall of the small-diameter hole;

wherein the stepped engagement portion further includes an inner hole engagement portion coaxially and protrudedly formed on the small-diameter portion, the inner hole engagement portion includes a third lateral surface on an outer circumferential surface thereof, the positioning hole further includes an inner hole communicated with and continuous from the small-diameter hole, the inner hole engagement portion is releasably inserted in the inner hole, and the third lateral surface corresponds to and is releasably tightly engaged with an inner wall of the inner hole;

wherein the small-diameter hole is smaller than the large-diameter hole in diameter and larger than the inner hole in diameter, and the small-diameter portion is smaller than the large-diameter engagement portion and larger than the inner hole engagement portion.

2. The display board with the at least one socket as claimed in claim 1, wherein when the stepped engagement portion is inserted in the positioning hole, the first lateral surface and the inner wall of the large-diameter hole are tightly engaged with each other annularly.

3. The display board with the at least one socket as claimed in claim 1, wherein when the stepped engagement portion is inserted in the positioning hole, the third lateral surface and the inner wall of the inner hole are tightly engaged with each other annularly.

4. The display board with the at least one socket as claimed in claim 1, wherein the inner hole engagement portion is tapered along an axial direction.

5. The display board with the at least one socket as claimed in claim 1, wherein the socket includes a socket body, a sleeve member and a ball body, the socket body is formed with an opening at the assembling end, the ball body is penetratedly disposed at the socket body and protrusive out of a surface of the socket body, the sleeve member is radially abutted in the opening and radially outwardly abutted against the ball body, the ball body is engagedly connected with the driving tool sleeved on the socket, a portion of the opening between an end of the positioning hole and the sleeve member defines the large-diameter hole, the sleeve member is formed with the small-diameter hole, and the first lateral surface and an inner wall of the opening are tightly engaged with each other annularly.

6. The display board with the at least one socket as claimed in claim 1, further including a shell member, the shell member pivoted to the main body and swingable between a limiting position and an opening position, the shell member including at least one blocking portion, wherein when the shell member is located at the limiting position, the at least one blocking portion corresponds to the at least one stepped engagement portion to limit the at least one socket sleeved on the at least one stepped engagement portion to remain between the at least one blocking portion and the main body; when the shell member is located at the opening position, the at least one blocking portion is away from the at least one stepped engagement portion to allow the at least one socket sleeved on the at least one stepped engagement portion to be disassembled from the at least one stepped engagement portion.

* * * * *